United States Patent [19]

Evans

[11] 4,291,773

[45] Sep. 29, 1981

[54] STRICTIVE MATERIAL DEFLECTABLE COLLAR FOR USE IN BOREHOLE ANGLE CONTROL

[76] Inventor: Robert F. Evans, 631 Honeywood La., La Habra, Calif. 90631

[21] Appl. No.: 101,854

[22] Filed: Dec. 10, 1979

Related U.S. Application Data

[63] Continuation-in-part of Ser. No. 928,703, Jul. 27, 1978, Pat. No. 4,211,292.

[51] Int. Cl.[3] ..... E21B 7/04

[52] U.S. Cl. ..... 175/61; 175/73; 175/320; 324/226

[58] Field of Search ..... 175/61, 73, 74, 320; 324/209, 226

[56] References Cited

U.S. PATENT DOCUMENTS

| | | | |
|---|---|---|---|
| 3,096,822 | 7/1963 | Hall | 166/55 |
| 3,731,752 | 5/1973 | Schad | 175/61 |
| 3,808,820 | 5/1974 | Bodine | 175/56 |
| 3,811,519 | 5/1974 | Driver | 175/73 |
| 3,853,186 | 12/1974 | Dahl et al. | 175/61 |
| 3,903,974 | 9/1975 | Cullen | 175/73 |
| 4,042,046 | 8/1977 | Capoccia | 175/73 |

*Primary Examiner*—James A. Leppink
*Attorney, Agent, or Firm*—John R. Ley

[57] ABSTRACT

A deflectable drill collar having strictive material deflectable elements is connected in a drill string of drilling apparatus. Energization of the strictive material deflectable elements, such as magnetostrictive elements, deflects the drill collar, thereby altering the axes of the drilling apparatus connected at opposite ends of the deflectable collar from a colinear relationship to a non-colinear relationship. Energizing means associated with the deflectable drill collar energizes the strictive material elements during preselected intervals of rotation of the drilling apparatus to place the cutting elements of a drill bit into more effective cutting relation with gage corner material of the borehole, or to articulate the drill string and force the drill bit in a desired direction. Apparatus for energizing the strictive material deflectable elements includes control and energy deriving apparatus attached to the drill string at a position at which gravity induced sag causes the drill string to contact the low side portion of the borehole during partial intervals of drill string rotation.

24 Claims, 16 Drawing Figures

STRICTIVE MATERIAL DEFLECTABLE COLLAR FOR USE IN BOREHOLE ANGLE CONTROL

CROSS REFERENCE TO RELATED PATENT

This is a continuation in part of U.S. patent application Ser. No. 928,703, filed July 27, 1978, which is now issued as U.S. Pat. No. 4,211,292.

BACKGROUND OF THE INVENTION

Field of the Invention

This invention relates to and is useful for selectively controlling the angle of a well hole or a borehole as it is cut through earth material or the like. More particularly, the present invention relates to a magnetostrictive or electrostrictive deflectable collar to be connected in a drill string. The deflectable collar can be energized to slightly bend or articulate the drill string or an attached drill bit to change the advancement angle of the borehole.

Brief Introduction and Description of Prior Art

A variety of different methods and arrangements to control the advancement angle of a borehole are known and conventionally employed. Although the majority of these approaches are successful and reliable, certain disadvantages are inherent. Usually, changing or controlling the borehole deviation or advancement angle requires use of special drill bits, support collars, and special methods of drilling. In each case, the conventional drill bit and drill string must be pulled from the borehole and the special equipment inserted. After achieving the desired angle change, the special equipment is removed and use of the conventional equipment is resumed. Of course, each time an angle change is made, there is an obvious loss of drilling penetration rate while the special equipment is inserted, used and then removed. Control and guidance equipment is typically required for conventional angle change apparatus and methods and this equipment is generally very expensive and may require the presence of specially trained personnel to operate and control the equipment. Since a major factor in drilling well holes is time consumed, it is important to maintain a good drilling or penetration rate and to minimize the time when actual drilling does not proceed. Reducing the costs involved in making angle changes with conventional equipment is a further important factor in reducing the total cost of drilling boreholes.

Other disadvantages and limitations are known and appreciated by those knowledgeable in the art. Many of these prior art disadvantages and limitations can be overcome or significantly minimized by the present invention.

OBJECTS OF THE INVENTION

It is the major object of this invention to provide new and improved methods and apparatus for controlling the advancement angle of a well hole or borehole cut by a rotary drill bit. Another object is to teach a new and improved approach to controlling the advancement angle of a borehole by use of strictive material deflection elements in a deflectable collar in a drill string.

Another objective is to maintain acceptable and normal rates of drilling penetration while simultaneously controlling the advancement angle of the borehole. Still another object is to obtain positive and reliable control over the change in advancement angle and to accomplish such with relative inexpensive, self-effectuating and reliable methods and apparatus.

Further objects are to utilize certain reliable elements of conventional drill bits and drilling apparatus to control the borehole advancement angle, to selectively control the drilling effect of the drill bit during each revolution in a consistently predictable manner, to simplify the apparatus needed to control and change the advancement angle of the borehole, to minimize the need for special equipment and specially trained personnel to effect changes in the borehole angle, to obtain and apply angle controlling forces and energy without sophisticated sensors, control arrangements and the like or by adoption for use with known sensing and controlling devices, and to further teach a method of controlling the deviation angle of a borehole from vertical to be inherently self-correcting. Other advantages and achievements of the present invention will be apparent to those knowledgeable in the art.

SUMMARY OF THE INVENTION

The present invention involves a deflectable collar having strictive material deflectable elements operatively connected to slightly bend or articulate the resiliently deflectable collar when the strictive material elements are appropriately energized. The strictive material elements are magnetostrictive or electrostrictive elements. The collar resiliently returns to a non-deflected condition when the elements are not energized. The deflectable collar is connected in the drill string, and when bent or articulated the axis of the drill string and drilling apparatus above and below the deflectable collar is changed from a colinear to a non-colinear relationship.

The advancement angle is controlled with the deflectable collar directly connected to the drill bit. When articulated for a partial revolution the collar causes the cutting elements of the drill bit to cut and remove a different amount of material over a selected partial arc of the circumference of the gage corner of the borehole, as compared to that amount removed over the remaining partial arc of the circumference of the gage corner. The arcuate portion over which less material has been removed applies a slight lateral force to the drill bit in the radial direction in which it is desired to angle the borehole.

The advancement angle is also controlled with the deflectable collar connected in the drill string at a position spaced above the drill bit. When the deflectable collar is bent, the drill string is articulated and the drill string below the deflectable collar angles the drill bit in a desired direction.

Control and energy deriving apparatus attached on the drill string at a predetermined position at which gravity induced sag causes the drill string to contact with the low side portion of the borehole is utilized in energizing the strictive material elements. The energy deriving apparatus derives energy from rotation of the drill string relative to the stationary low side of the borehole sidewall. The energy is derived in pulses of duration related to the partial interval of drill string rotation during which the energy deriving apparatus contacts the sidewall. The energy pulses operatively energize or control the energization of the strictive material elements. The angular positional relationship between the direction in which the deflectable collar is deflected and the energy deriving means is selected to achieve a desired direction of angle advancement relative to the stationary low side portion of the sidewall.

The present invention is defined in the appended claims. A more complete understanding of the invention can be obtained from the following description of a preferred embodiment and from the drawings consisting of a number of figures.

BRIEF DESCRIPTION OF THE DRAWINGS

FIG. 8 illustrates a piston and cylinder activation means, and FIG. 9 illustrates an electrical solenoid activation means.

FIG. 14 is a view related to the view shown in FIG. 11.

FIG. 16 illustrates the arrangement by which the deflectable collar is continually deflected in a stationary direction during rotation of the drill string.

DETAILED DESCRIPTION OF PREFERRED EMBODIMENTS

By way of general introduction, the present invention controls the advancement angle of the borehole by at least two different methods. One method proceeds by intentionally creating uncommon drilling effects in a particular type of well hole or borehole. The characteristics of the borehole, as well as a discussion of one well known rotary drill bit having cutting elements is discussed in the first section below. A discussion of the general concepts and method of creating the uncommon drilling effects and the resultant advancement angle control are discussed in the second section below. Exemplary control and energy deriving arrangements for use in conjunction with a strictive material deflectable collar of the present invention is discussed in the third section below. The fourth section discloses one embodiment of a strictive material deflectable collar of the present invention. Lastly, the fifth and sixth sections discuss the application of deflectable collars of the present invention in controlling the borehole advancement angle.

ROTARY DRILL BIT AND BOREHOLE CHARACTERISTICS

Figure 1:
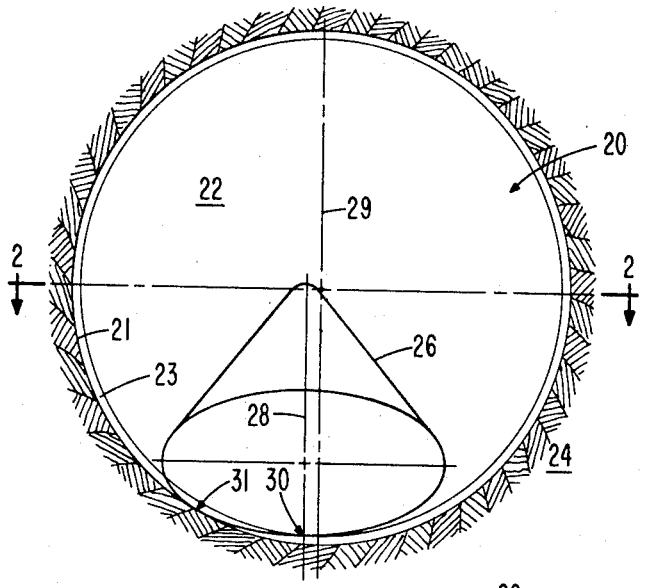
FIG. 1 is a top view looking axially into a borehole of one type to which the present invention relates and which is formed by a schematically illustrated cone cutter assembly.
Figure 2:
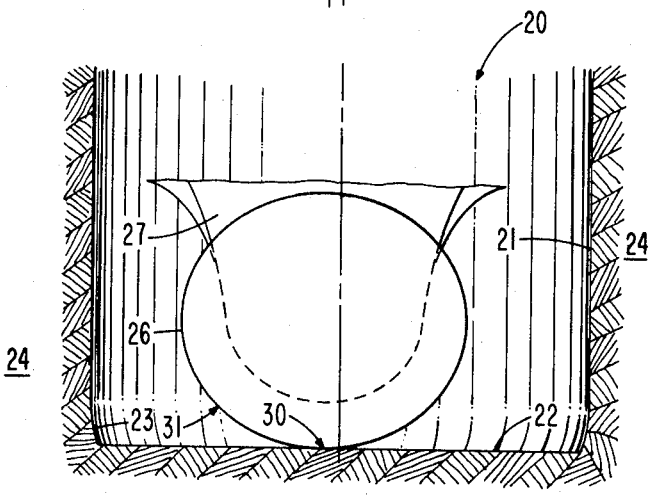
FIG. 2 is an axially extending section view taken substantially in the plane of line 2—2 of FIG. 1 and schematically illustrating the maximum circumference of the radial outermost cutting wheel element of the cone cutter assembly.

The characteristics of the borehole to which the present invention relates, and one type of rotary drill bit which effectively cuts a borehole having these characteristics, are known in the art. Referring to FIGS. 1 and 2, a borehole 20 is shown to include a cylindrical sidewall portion 21 which extends generally coaxially with the axis of the borehole, a drill face portion 22 extending essentially transversely with respect to the cylindrical sidewall portion 21, and a gage corner portion 23 which extends circumferentially around the outer periphery of the drill face 22 and radially outward at an inclination to the sidewall 21. Of course, the sidewall and drill face and gage corner portions are defined by the surrounding earth material 24 as the borehole 20 is cut. It is to rotary drill bits which cut a gage corner portion 23 of the borehole that this invention relates, in certain aspects.

One commonly used and very effective type of rotary drill bit which cuts a borehole having the sidewall 21 and drill face 22 and gage corner 23, is the well-known offset three-cone bit, one example of which is disclosed more fully in U.S. Pat. No. 2,148,372 to Garfield. An offset three-cone bit utilizes three groups of rolling cutting wheels and cutting elements, and each group or cutting assembly is formed in a general overall shape of a cone. Each of the cone-shaped cutting assemblies is offset, meaning that the rotational axis of each assembly extends at a slight intersecting angle or in spaced parallel relation with respect to a radial reference from the axial and rotational center of the drill bit. In both cases, the cone assembly axis does not pass through the bit axis. It is this offset geometry which causes the cone cutter assemblies to cut or leave the gage corner 23 as the borehole is cut. One offset cone cutter assembly 26 is schematically illustrated in FIGS. 1 and 2. A bit support structure 27 positions the cone cutter assembly 26 with its axis 28 of rotation offset in spaced parallel relation to a radial reference 29 extending from the axial and rotational center of the bit support structure 27. A description of the intersecting-angle geometry of an offset cone cutter assembly is present in the above identified Garfield patent. Both types of offset geometry are well known in the art.

The effect of the offset geometry is to create the gage corner portion 23, as can be generally understood from FIGS. 1 and 2. Due to the offset of each cone cutter assembly 26, the point 30, which is axially or vertically below the axis 28 of rotation of the cone cutter assembly 26, is spaced a slight radial distance inward with respect to the cylindrical sidewall 21. Another point 31 circumferentially displaced from the point 30 is the point at which the rotating cone cutter assembly 26 cuts the maximum diameter or gage of the borehole 20, and thus, also defines the cylindrical sidewall 21. As seen in FIG. 2, the point 31 is axially displaced from the drill face 22 and from the point 30. Because point 30 is located radially inward with respect to point 31 due to the geometry of the offset cone cutter assembly 26, a sloping or inclined gage corner 23 is formed between the point 31 at maximum diameter of the cyindrical sidewall and the point 30 at the maximum diameter of the drill face. The material between points 30 and 31 is typically curved, and it is this material which defines the gage corner 23. The cutting elements radially inwardly spaced from the point 30 on the cone cutter assembly 26 remove particles of material 24 to define the drill face 22.

The advantages of an offset three-cone rotary drill bit are well known. The offset geometry of the cone cutter assemblies achieves a combination of rolling and scraping action on the earth material defining the drill face and gage corner. The rolling and scraping action removes particles of material much more effectively and more quickly than if the offset geometry was not utilized. Due to the proven advantages of the offset three-cone bit, it is expected that such a bit will be utilized in either a substantially original or slightly modified form in practicing the present invention. It should be understood, however, that other types of rotary drill bits which cut a circumferential gage corner extending at an inclination outward from the drill face to the sidewall are within the scope of the present invention.

The substantial advantage to utilizing the offset three-cone bit or a similar bit in practicing the invention is that no reduced effectiveness or loss of penetration rate occurs as the borehole is cut and simultaneously angled in the desired manner. Many prior art approaches of controlling the advancement angle of the borehole require removal of the conventional drill bit and insertion into the borehole of special cutting devices and the like. Other prior art approaches involve stopping the rotation of the drill bit and attached drill string while an auxiliary cutting effect takes place. In most prior art approaches, alterations in structure of the bit or in the way in which the bit is operated in terms of revolutions per minute, weight on the bit or hydraulic cuttings removal are required, and these alterations adversely affect performance and the drilling penetration rate. Maintaining a good drilling rate is particularly important because of the economics involved in drilling and in angling or correcting the direction of a borehole. The extra drill rig time consumed, the cost of extra or special tools, and the cost of extra and specialized skilled personnel can amount to a considerable expense with the currently used approaches to angle control.

ANGLE CONTROL

Figure 3:
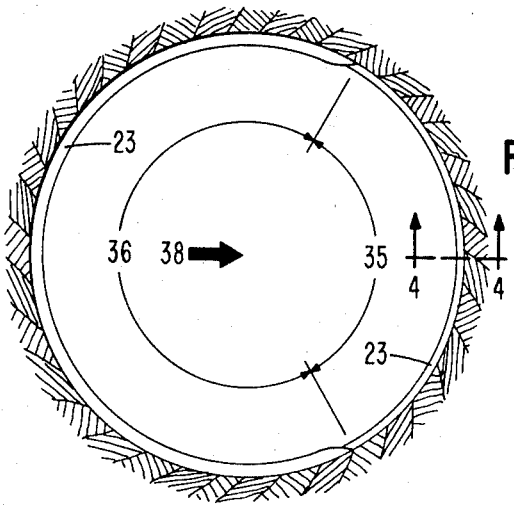
FIG. 3 is a top view similar to FIG. 1 illustrating a selected partial arcuate portion of the circumference of the gage corner and a remaining arcuate portion of the circumferential gage corner.
Figure 4:
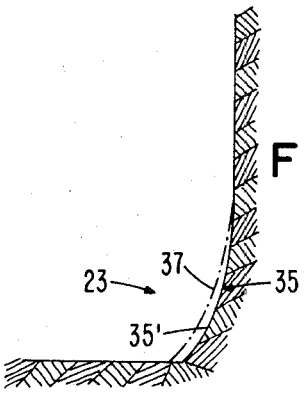
FIG. 4 is an enlarged fragmentary section view illustrating removal of a different amount of the gage corner of the borehole, taken in an axially extending section plane of line 4—4 of FIG. 3.

To control the angle of advancement of the borehole cut by the rotary drill bit, a different amount of material is removed over a partial preselected arc of the circumference of the gage corner than the amount of material removed over the remaining partial arc of the circumference of the gage corner. FIGS. 3 and 4 schematically illustrate this angular control concept. The partial preselected arc is referenced 35 in FIG. 3, and the remaining arc of the circumference of the gage corner 23 is referenced 36. FIG. 4 illustrates in exaggerated condition an additional amount of material removed from the preselected arc 35. The dotted lines 37 indicate, for comparison purposes, a normal amount of material which would normally define the gage corner resulting from normal operation of the drill bit. By removing additional material to a level indicated by the solid line 35', the size and radial inclination of the gage corner 23 is slightly reduced over the arc 35. However, the size and inclination of the gage corner material in the remaining arc 36 is that normally cut by the rotary drill bit, represented at 37. Consequently, the remaining arc 36 of the gage corner extends radially inward at the full or normal inclination.

The remaining partial arc 36, being of full normal size and inward inclination, applies a slight radially inward directed or lateral force on the drill bit in the general radial direction of the selected arc 35. The slight lateral force is illustrated by a vector referenced 38. In time after a sufficient number of drill bit revolutions, the lateral force applied with each revolution effectively forces the drill bit in the direction of the vector 38. The drill bit begins to advance laterally in the direction of vector 38, and the advancement angle of the borehole is changed.

The manner in which one arcuate portion of the inclined gage corner 23 applies lateral force on the drill bit to control the advancement angle is somewhat similar in overall effect to a whipstock effect known in the art to occur when a conventional drill bit encounters a sloping geological formation of different hardness. The whipstock effect simply describes a naturally-occurring physical result, in contrast to the present invention, which selectively and positively creates angle control effects on the drill bit. One description of the whipstock effect and a further description of the offset three-cone drill are found in an article appearing in *Drilling*, May, 1965, Page 34.

The amount of material removed with each revolution over the preselected arc need not be large to control the advancement angle. In fact, very small amounts will achieve acceptable angular control. Removal of a very small amount over the preselected arc during each of a plurality of subsequent revolutions creates anistropic action sufficient to achieve significant angular deviation. As an example, it is possible to change the angle of the borehole advancement by approximately 1° by forcing the drill bit laterally by an amount of two to three thousandths of an inch during the course of drilling 100 feet which requires many thousands of revolutions of the bit. It is apparent, therefore, that by operating the drill bit and creating different gage corner removal effects over a sufficient time period, sizeable angle deviation build-up will occur and effective control over the advancement angle of the borehole results. Such lateral drilling rates are not difficult to obtain and can be achieved without sacrificing the normal adequate performance of the rotary drill bit.

It should also be noted that in addition to removing an additional amount of material over that which would normally be removed, as is the situation illustrated in FIG. 4, the concept of the present invention also involves inhibiting the removal of a normal amount of gage corner material over one partial arc while allowing normal removal of the material over the remaining partial arc. Of course, the overall effect of either removing additional material or inhibiting normal removal of material is the same: a lateral force is applied to the drill bit by the arcuate portion of the gage corner circumference over which the greater amount of material remains, and the drill bit is angled appropriately.

To achieve suitable angle control, the different amount of material must be removed over the preselected arc during each of a number of sequential revolutions. Furthermore, the angular positions of the beginning and ending points of the preselected arc must be approximately the same during each revolution of the drill bit so that the lateral force 38 is applied approximately in the same lateral direction to the drill bit during each revolution. One advantageous arrangement for achieving this effect is next described.

CONTROL AND ENERGY DERIVING ARRANGEMENT

To control the advancement angle, strictive material deflectable elements of the deflectable collar of the present invention, described in detail in the following sections, are energized during a selected partial interval of one or each rotation of the drill bit and, in some embodiments, the drill string. It is therefore important to energize and de-energize the strictive material deflectable elements of the deflectable collar to deflect the collar at approximately the same rotational positions during each revolution. The interval of rotation during which the deflectable elements are energized corresponds in angular duration to the selected arc of the circumference of the gage corner over which the different amount of material is removed or to the rotational interval during which the drill string is articulated.

One arrangement, not specifically shown, involves control means at the surface of the earth which is operatively connected for energizing the strictive material deflectable elements of the deflectable collar over the preselected rotational arc and interval of each revolution. Such control means employs sensors or the like for determining the rotational position of the drill bit and drill string as they are continually rotated, and such control means selectively supplies energy to the deflectable strictive elements during the selected and predetermined interval of drill bit rotation.

A more appropriate control means for activating or energizing the deflectable strictive elements of the deflectable collar from energy derived from rotation of the drill string relative to the borehole sidewall is illustrated in FIGS. 5 to 9. The borehole 20 shown in FIG. 5 extends axially downward at an angle with respect to a vertical reference. A rotary drill bit 40 is attached to the end of a drill string 41 and inserted into the borehole. The drill string 41 comprises a plurality of conventional drill collars 48 connected together in a manner known in the art. The drill bit 40 is attached to the end of the drill string and placed in contact with the drill face 22 of the borehole. The drill string 41 extends through the borehole 20 to the surface of the earth where conventional drilling apparatus 44 is connected to the drill string for rotating the drill string and the drill bit connected at the end of the drill string. Of course, rotating the drill bit at the drill face cuts and removes particles of the material 24 to advance the borehole.

Because the drill string 41 extends at an angle with respect to a vertical reference, gravity bends or induces the drill string toward the low side portion of the cylindrical sidewall of the borehole. The gravity induced sag in the drill string causes it to contact the low side portion of the sidewall at a point 42 axially spaced from the drill face and drill bit. Means, generally referenced 43, are fixed to the drill string at point 42 for the purpose of deriving energy from rotational movement of the drill string relative to the stationary cylindrical sidewall over a selected partial interval of each rotation of the drill string during which the means 43 contacts the low side portion of the sidewall. Of course, the distance between the drill bit and the point 42 will vary depending upon a number of factors including the angle of the borehole 40 with respect to a vertical reference and the stiffness of the drill collars comprising the drill string.

Figures 6, 7:
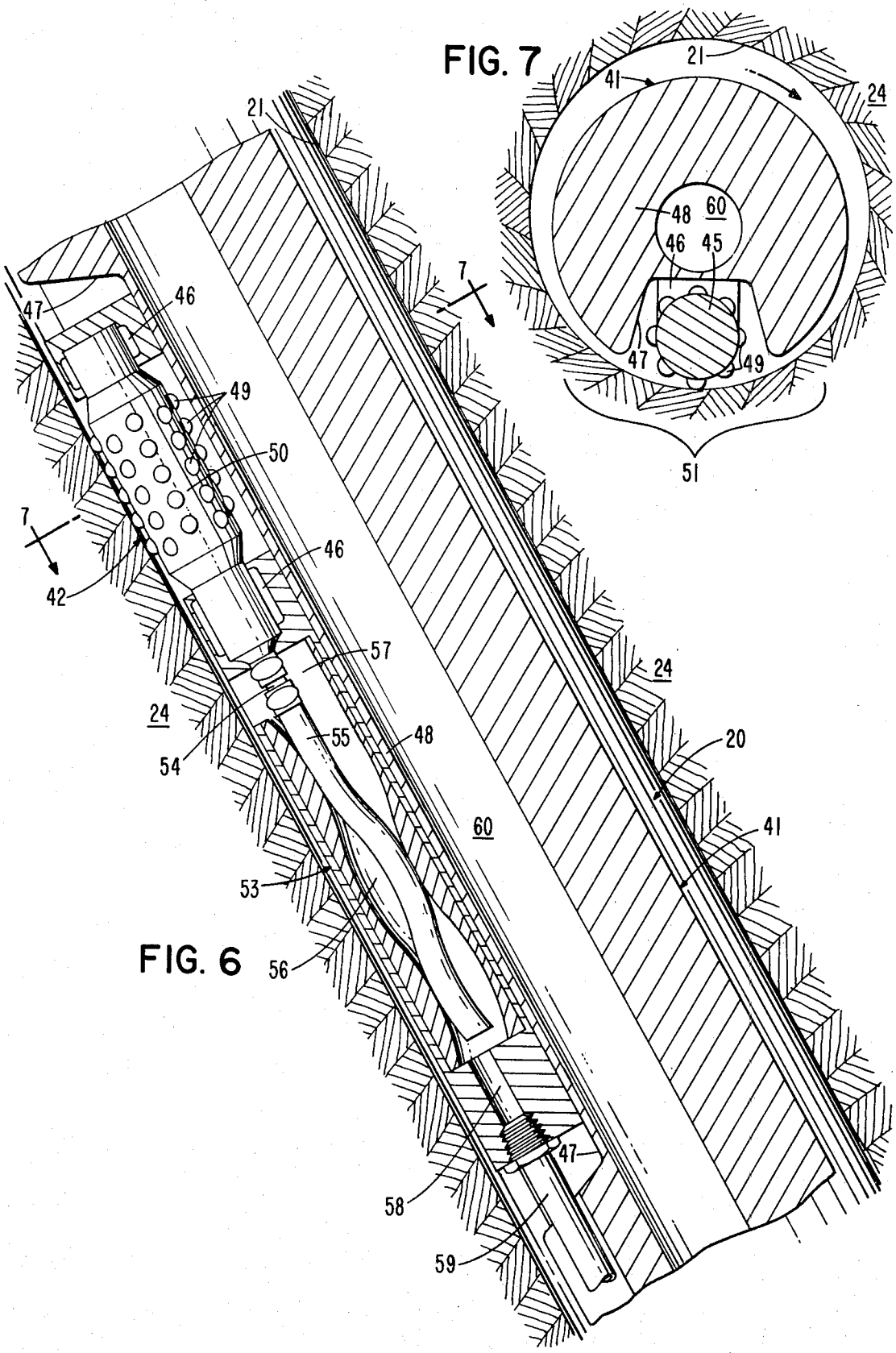
FIG. 6 is an axially extending section view taken substantially in the plane of line 6—6 of FIG. 5, in which the drill string and control and energy deriving apparatus have been rotated 180°.
FIG. 7 is a transverse section view taken substantially in the plane of line 7—7 of FIG. 6.

One example of means 43 for deriving energy is illustrated in FIGS. 6 and 7. A roller member 45 or other driver means is fixed in an exposed condition to the exterior surface of the drill string 41. Conventional bearing connection means 46 attach the roller member 45 to the drill string, and the bearings 46 allow the roller member to rotate relative to the drill string. The roller member 45 and bearings 46 are received within a milled pocket 47 formed in the exterior surface of a drill collar 48 comprising a portion of the drill string 41. Teeth 49 or other frictional engagement members extend from an outer cylindrical surface 50 of the roller member 45. The teeth 49 of the roller member are exposed at the outer periphery of the drill string and are thus free to contact and roll against the low side portion of the sidewall 21 at the point 42. The teeth 49 are made of conventional wear-resistant material. A conventional drilling fluid passage 60 extends axially through the drill collar 48 and the drill string 41.

As the drill string 41 rotates, the roller member 45 is periodically rotated into contact with the low side portion 51 of the cylindrical sidewall 21, as is shown in FIG. 7. During contact with the low side portion 51, the teeth 49 contact the sidewall 21, and the rotation of the drill string relative to the stationary sidewall causes the roller member 45 to rotate about its bearing connection means 46. With further drill string rotation, the roller member 45 moves to a position at which the teeth 49 no longer contact the cylindrical sidewall. Thus, roller member 45 contacts and rolls against the low side portion 51 of the cylindrical sidewall during a predetermined partial interval of drill string rotation, and, during the remaining partial interval of the drill string rotation, the roller member 45 avoids contact with the sidewall 21. This periodic contact results because the axial center of the drill string does not coincide with the axial center of the borehole 20 due to the sag induced by gravity.

Thus, the roller member is rotated during a selected partial interval of the drill string rotation and is not rotated during the remaining partial interval of drill string rotation. Rotation occurs at the same rotational position of the drill string during each revolution, since the roller member is at a fixed position and the low side portion 51 presents a stationary surface upon which the roller member periodically contacts and rolls against.

Rotational movement of the roller member 45 is applied to an energy generator means to generate energy. As shown in FIG. 6, a hydraulic pump 53 such as a conventional progressive cavity pump is operatively connected by connection means 54 to be rotated by the roller member. The connection means 54 transmits rotation from the roller member 45 to the pump 53 and rotates a screw-like rotor member 55 within a helical shaped stator 56. An intake opening 57 at one end of the stator 56 receives fluid utilized by the pump 53. The fluid is forced through a series of progressive cavities formed by interaction of the rotating rotor member 55 and stationary stator 56, and the fluid is pressurized and delivered from an outlet opening 58 of the pump 53. A conduit 59 connected at the outlet 58 of the pump conducts the pressurized fluid for use by energy generator means associated with the pump 53. The conduit 59 extends along the exterior of the drill string 41 preferably within a milled channel, not shown, or extends within the interior of the drill string. The supply of hydraulic fluid for the pump 53 is obtained from a conventional source, such as the outflow of fluid flowing out of the borehole between the drill string and the cylindrical sidewall or the drilling fluid in the passage 60.

It is apparent from the foregoing description of the energy deriving means 43 that the pump 53 supplies energy only when rotated by the roller member 45. The roller member 45 is rotated only during the partial interval of each rotation of the drill string when the roller member contacts and rolls against the low side portion of the cylindrical sidewall. Therefore, the energy is supplied in the form of pulses delivered during the time interval that the roller member contacts and rolls against the cylindrical sidewall.

Figures 5, 8, 9:
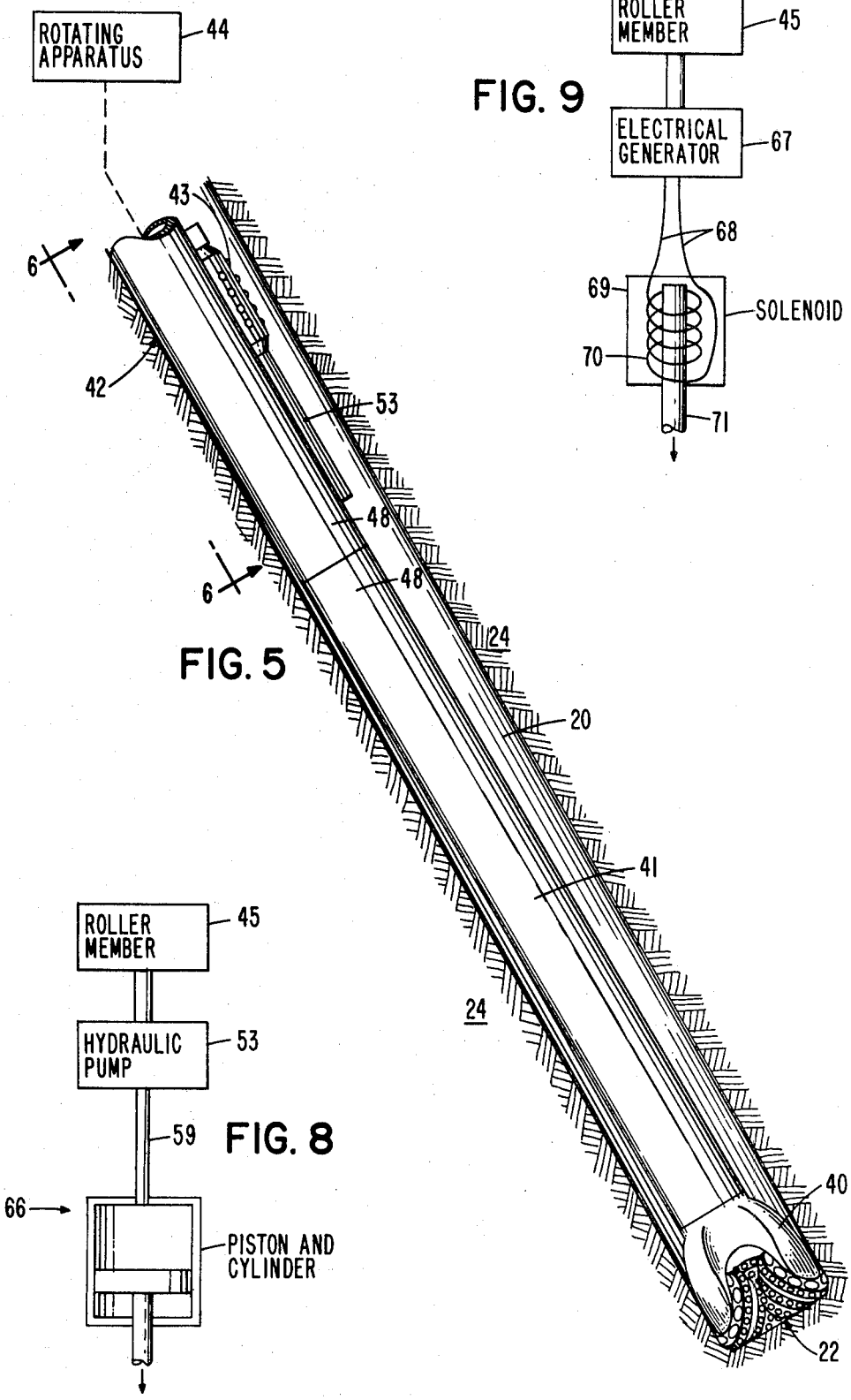
FIG. 5 is an axially sectioned view of a borehole extending at an angle from a vertical reference into which a drill string and drill bit have been inserted, and a schematic view of a control and energy deriving means of the present invention.
FIGS. 8 and 9 are schematic illustrations of actuating means associated with the control and energy deriving apparatus of the present invention. Specifically.

One example of activation means utilizing the hydraulic pressure pulses is a piston and cylinder arrangement 66 schematically illustrated in FIG. 8. The pulses of pressurized hydraulic fluid are supplied to the piston and cylinder arrangement 66 and force the piston to move. The moving piston activates a conventional energy generator means, such as a linear motion electrical generator. Another example of activation means is illustrated in FIG. 9. The roller member 45 is operatively connected to directly operate an electrical generator 67. Electrical energy derived from the operating generator 67 is supplied over conductors 68 to a solenoid arrangement 69. The solenoid includes a conventional coil 70 for producing electromagnetic flux which acts on and moves a magnetic armature 71 or magnetostrictive elements utilized with the deflectable collar, as will be described subsequently.

In the described manner, energy is derived from rotation of the drill string relative to the cylindrical sidewall by energy deriving means 43. The energy derived is applied to the deflectable collar, as will be described, and the deflectable collar is deflected or bent to achieve angle control effects. The deflectable collar is deflected only so long as the pulse of energy is applied to its deflectable elements. The pulse of energy is applied during the interval of drill string rotation that the roller member 45 contacts the low side portion 51 of the sidewall. The interval of drill string rotation corresponds or bears a predetermined relationship to the angular duration of the deflection. By adjusting the predetermined angular positions of the deflectable collar and the energy deriving means a physical relationship is established between the stationary low side portion 51 of the borehole and the direction in which it is desired to angle the borehole. The direction in which the borehole will be angled is determined by the angular position over which the collar is deflected. The deflection can be oriented in any angular direction relative to the low side of the borehole sidewall to advance the borehole at a desired angle. By selecting the proper angular relationship of the roller member 45 and the deflectable collar, an arrangement for automatically correcting any significant deviation of the borehole from vertical is obtained.

Although one roller member 45 has been illustrated connected to the drill string, it may prove advantageous to employ three equally circumferentially spaced rollers about the outer exterior surface of the drill string. Three equally spaced rollers would reduce lateral force impulses supplied to the drill string as each roller rotates into contact with the low side portion of the sidewall. The three equally spaced rollers have a smoothing effect since one of the rollers would probably be in contact with the low side portion at all times. All three rollers could be connected to separate hydraulic pumps or electrical generators. The output energy of each electrical generator or pump could be appropriately controlled or delivered for use in controlling a drilling operation of the nature described. Energy deriving means can be employed at a number of different axial distances from the drill bit. An appropriate control arrangement controls the deflectable collar by energy derived from selected ones of the energy deriving means.

MAGNETOSTRICTIVE DEFLECTABLE COLLAR

Figure 10:
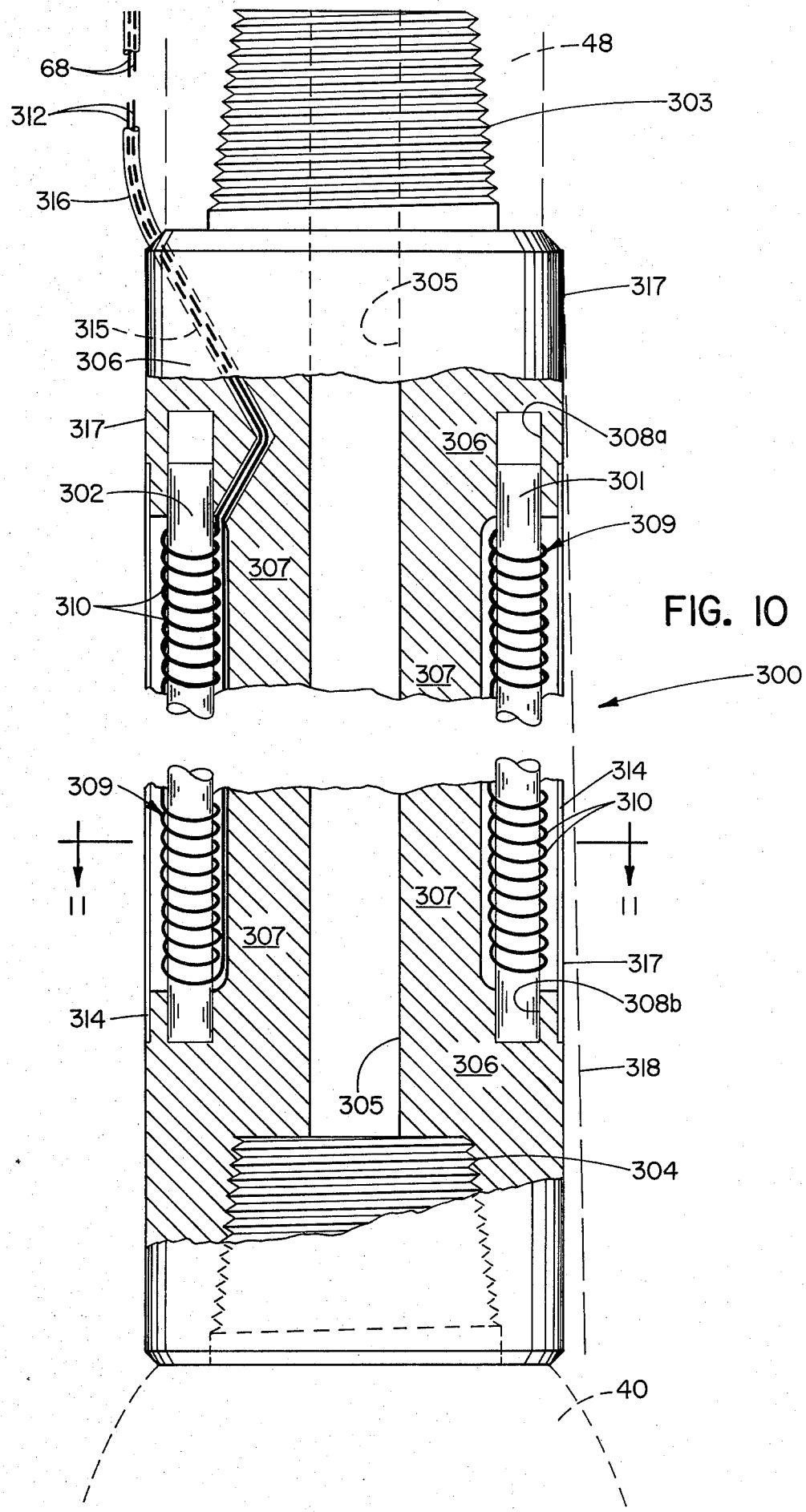
FIG. 10 is a side elevational view of a deflectable collar with a center portion broken out partially in an axial section view and partially in elevation to illustrate elements of the deflectable collar. A drill string and drill bit are illustrated in phantom as connected to the deflectable collar.
Figure 11:
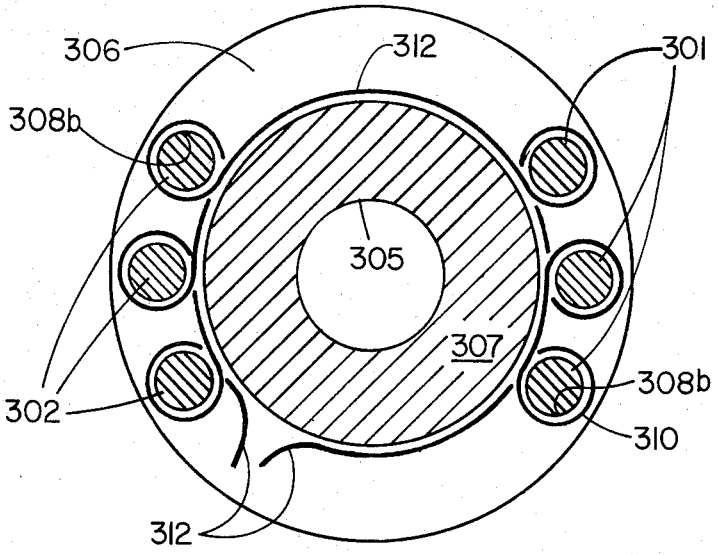
FIG. 11 is a transverse section view taken substantially in the plane of line 11—11 of FIG. 10.
Figure 13:
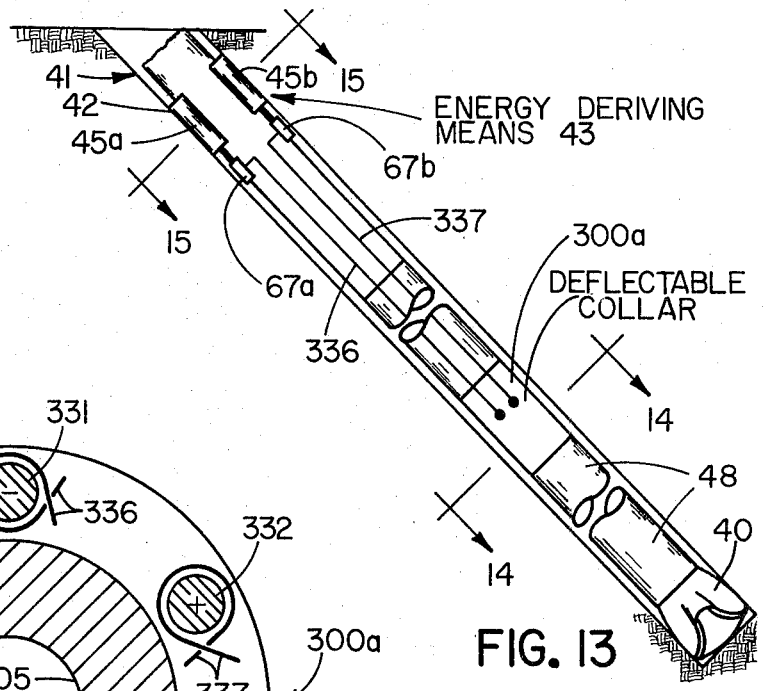
FIG. 13 is a schematic illustration of drilling apparatus related to that shown in FIG. 12 which illustrates another embodiment of control and energy deriving apparatus utilized in conjunction with another embodiment of a deflectable collar related to that deflectable collar shown in FIGS. 10 and 11.

A deflectable collar 300 of the present invention shown in FIGS. 10 and 11 comprises a plurality of strictive material elements such as magnestostrictive elements 301 and 302 operatively connected to bend or deflect the deflectable collar 300 when appropriately energized. The deflectable collar 300 includes an upper threaded male end 303 adapted to threadably connect with a conventional drill collar such as the endmost drill collar 48' of the drill string 41. The deflectable collar 300 also includes a lower female threaded receptacle 304 adapted to threadably connect to another drilling apparatus such as the drill bit 40 or another conventional drill collar 48 (FIG. 13). A passage 305 extends axially through the deflectable collar 300 in alignment with the drilling fluid passage 60 in the drill collars of the drill string 41. The passage 305 conducts the drilling fluid from the passage 60 through the collar 300.

Each of the magnetostrictive elements 301 and 302 preferably take the form of an elongated rod. The rod-like magnetostrictive elements 301 and 302 extend axially or longitudinally between enlarged end portions 306 of the deflectable collar 300. A middle solid portion 307 of the collar 300 is of reduced cross sectional area and is radially adjacent the magnetostrictive elements 301 and 302. The reduced cross sectional area of the middle portion 307 allows the drill collar 300 to more easily bend or deflect through its center or middle, but the strength of the middle portion 307 is sufficient to couple rotational forces and withstand the required weight transmitted through the deflectable collar 300 to the drill string and drilling apparatus connected to the end portions 303 and 304. The opposite ends of the magnetostrictive elements 301 and 302 are received in sockets 308*a* and 308*b* formed in the enlarged end portions 306. The sockets 308*a* are sufficiently elongated to allow one end of each element 301 and 302 to be inserted a sufficient amount so the other end of each element 301 and 302 can be inserted into the socket 308*b* during assembly. The ends of the magnetostrictive elements are retained in the sockets by brazing or welding or otherwise rigidly connecting them to the end portions 306. The sockets are radially outwardly spaced from the axial center of the collar 300 near an outermost curved surface 317 of the collar 300 so that maximum leverage is applied from the elements 301 and 302 for deflecting the collar.

The magnetostrictive elements 301 are positioned on a diametrically opposite side of the deflectable collar than the magnetostrictive elements 302, as also shown in FIG. 11. The magnetostrictive elements 301 and 302 are respectively of negative and positive types of magnetostrictive material. A negative magnetostrictive element will elongate negatively or contract in length when a magnetic field is applied to the element, and a positive magnetostrictive element will elongate positively or increase in length under the influence of the magnetic field applied to the element. Material of 50% to 55% nickel and the balance of iron has a maximum positive magnetostrictive elongation while material of essentially pure nickel has a maximum negative elongation.

A magnetizing solenoid 309 is operatively associated with and surrounds each magnetostrictive element for the purpose of creating and applying a magnetic field to the elements 301 and 302. A plurality of coils 310 of an electrical conductor 312 is formed around each magnetostrictive element and defines each magnetizing solenoid 309. One electrical conductor 312 is shown as defining the plurality of series connected coils 310, although any electrical connection arrangement of the solenoids which creates a magnetic field of sufficient strength to expand and contract the magnetostrictive elements can be utilized.

A thin cylindrical shield 314 extends between the end portions 306 as a continuation of the exterior surface 317 to prevent the direct exposure of the magnetostrictive elements 301 and 302 and the magnetizing solenoids 309 to the outflow of drilling fluid and particle cuttings flowing from the borehole in the annular space exterior of the deflectable collar 300. The shield 314 is sufficiently thin and flexible to allow relatively unimpeded deflection of the collar 300.

A channel 315 is formed through the upper enlarged end portion 306 shown in FIG. 10 and a conduit 316 extends from the channel 315 alongside the endmost drill collar 48' and the other drill collars defining the drill string. The purpose of the channel 315 and conduit 316 is to encase and protect each conductor 312 which extends within the channel 315 and conduit 316.

Upon the application of a current to the conductor 312 a magnetic field is directly applied to each of the magnetostrictive elements 301 and 302. The positive magnetostrictive elements 302 expand in length while the negative magnetostrictive elements 301 contract in length. In the example shown in FIG. 10 the expanded elements 302 and diametrically opposite contracted elements 301 cause the drill collar to deflect or bend concavely to the right, as shown by the dashed lines at 318, and the lower end of the collar 300 adjacent the female threaded receptacle 304 is transversely shifted to the right. When deflected, the axes of the drilling elements connected to opposite ends of the deflectable collar are shifted into a non-colinear relationship.

The collar 300 remains deflected so long as a magnetic field is applied to the magnetostrictive elements 301 and 302. That magnetic field is present when current flows through the plurality of coils 310 and the conductor 312. It is possible to deflect the collar 300 by attaching strictive material elements of only positive or negative elongation characteristics on only one side of the drill collar. However by using both positive and negative strictive material elements positioned on diametrically opposite sides of the collar, the positive and negative elongation effects are additive to more effectively deflect the collar.

Although magnetostrictive elements 301 and 302 have been described for use in deflecting the drill collar 300, electrostrictive rod-like elements can also be utilized. Electrostrictive elements contract or expand under the influence of a voltage. It is necessary to insulate the electrostrictive elements, as well as securely attach them to the deflectable collar, so that the voltage can effectively be applied only to the electrostrictive elements and not be shorted through the conductive metallic material from which the collar 300 is constructed.

The term "strictive" as used herein in reference to materials refers to magnetostrictive materials or electrostrictive materials.

ANGLE CONTROL BY GAGE CORNER EFFECTS

Figure 12:
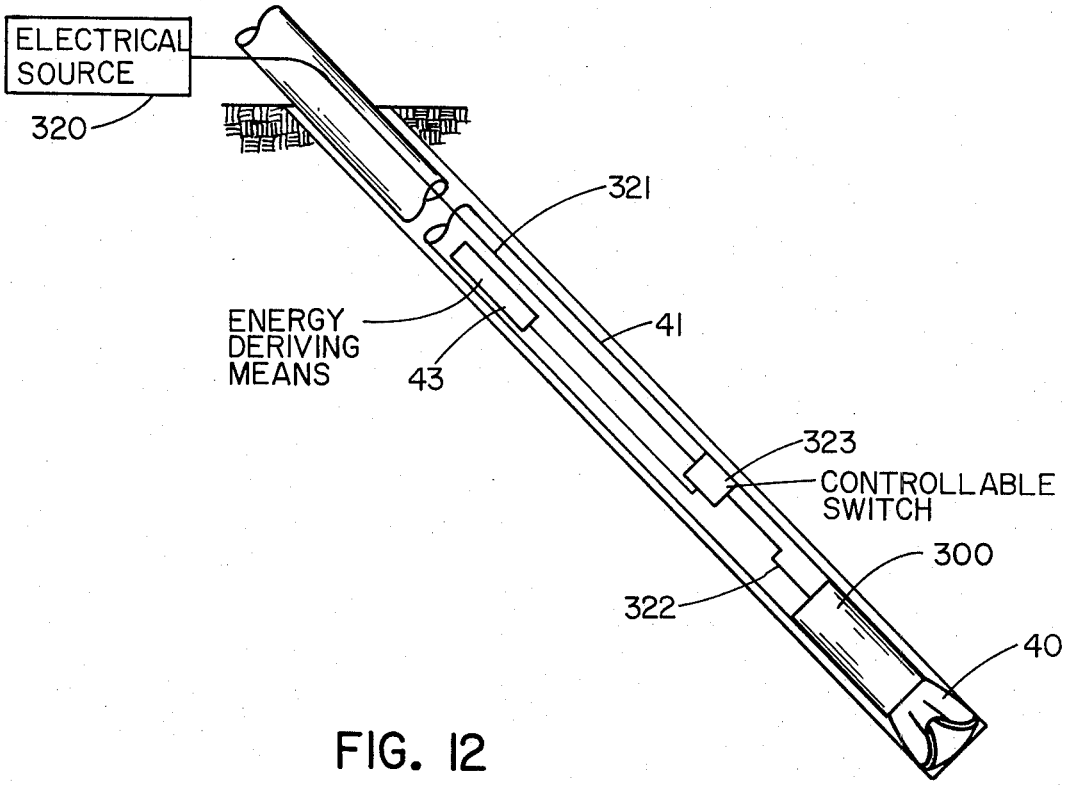
FIG. 12 is a schematic illustration of drilling apparatus including control and energy deriving apparatus utilized in conjunction with a deflectable collar of the present invention for creating gage corner removal effects.

If the drill bit 40 is directly connected to the collar 300 as shown in FIGS. 10 and 12, the cutting elements on the left hand side of the drill bit, as viewed from FIG. 10, are forced more directly axially downward when the collar 300 is deflected than when the collar 300 is not deflected. When forced more directly downward, the drill bit cutting elements more effectively cut and remove the material defining the gage corner 23, and the gage corner is cut and removed to the level 35', shown in FIG. 4, as compared to the level 37 which the drill bit cutting materials would normally cut and remove the gage corner material 23 when the collar 300 is not deflected. The gage corner material will be more effectively removed over the preselected arc 35 shown in FIG. 3 during the interval of drill string rotation during which the collar 300 is deflected. The remaining arc 36 will thereafter apply a slight lateral force 38 directly to the drill bit causing the drill bit to angle or advance in the desired direction, as has been previously described.

By initiating and terminating the electrical current through the solenoids 309 at predetermined points or times in the rotation of the drill string, the collar 300 will remain deflected during a predetermined portion of each drill string and drill bit revolution. Also the deflection can be made to occur over the same preselected arc or interval of rotation from one revolution to the next to achieve a cumulative result over a large number of revolutions. Thus even though the amount of deflection may be relatively small, the effects after many hundreds or thousands of revolutions is significant and sufficient to control the borehole advancement angle.

One arrangement for controlling the deflection of the deflectable collar 300 over approximately the same preselected arc of rotation and at approximately consistent positions, intervals and durations from one revolution of the drill string to the next is the energization or activation means schematically illustrated in FIG. 9. The roller member 45 of the energy deriving means 43 (FIGS. 5 to 7) connected to the drill string 41 periodically contacts the point 42 at which the gravity induced sag in the drill string causes it to contact the low side portion 51 of the sidewall of the borehole. The electrical generator 67 is driven by the roller member 45 and supplies electrical current over the conductors 68. The conductors 68 are connected in series with the conductor 312, thereby causing the current from the electrical generator 67 to flow through the plurality of coils 310 which define the magnetizing solenoids 309. So long as the roller member 45 contacts and rolls against the sidewall of the borehole, current is supplied and the magnetic field is applied to and influences the magnetostrictive elements 301 and 302 to deflect the collar 300. When the drill string 41 rotates the roller member 45 out of contact with the low side portion of the borehole, the electrical current terminates and the collar 300 is no longer deflected. In this manner, the drill collar is deflected only over a predetermined partial selected arc or interval of the drill string rotation and is not deflected over the remaining arc or interval of drill string rotation. Since the roller moves into and out of contact with the low side portion 51 of the borehole sidewall at approximately consistent positions from one revolution to the next, the duration and position of the rotational interval over which deflection occurs are essentially also consistent. Consequently, the relatively small amount of deflection during each revolution is cumulative over a large number of sequential revolutions.

Another embodiment of a control arrangement for deflecting the deflectable collar 300 is illustrated in FIG. 12. An electrical source 320 of current is positioned on the surface of the earth or at some other location for use with the drilling apparatus. Conductors 321 and 322 conduct the current from the source 320 to the magnetizing solenoid 309 of the deflectable collar 300 (FIG. 10) attached to the drill string 41. Conductor 322 is directly connected to the conductor 312 which defines the coils 310 of the magnetizing solenoid 309. A controllable switch 323 selectively connects conductor 321 to conductor 322 when energized. The switch 323 is operated by the energy deriving means 43 positioned at the predetermined position on the drill string 41. As the roller member 45, or some other element of the energy deriving means 43, comes in contact with the low side portion of the sidewall, the energy deriving means 43 operatively closes the switch 323. Current is conducted from the source 320 to the magnetizing solenoids 309. When the roller member of the energy deriving means moves out of contact with the sidewall, the switch 323 is opened. The switch 323 is thereby controlled to conduct current from the source 320 to the magnetizing solenoids of the deflectable collar 300 during the interval of the drill string rotation which the roller member contacts and moves against the low side portion of the sidewall. The switch 323 causes the deflection of the deflectable collar 300 during a predetermined consistent interval of rotation from one revolution to the next in relation to the reference provided by the low side portion of the borehole. The switch 323 may be electrically or mechanically activated by the energy deriving means as illustrated by FIGS. 8 and 9, or by other similar mechanical and electrical arrangements.

ANGLE CONTROL BY DRILL STRING ARTICULATION

A deflectable collar of the present invention can be employed to bend or articulate the drill string at a position substantially above the drill bit. Articulating the drill string at a position substantially above the drill bit angles the lower portion of the drill string and forces the drill bit in a desired direction to change the borehole advancement angle, rather than placing the cutting elements in a different cutting relationship with the gage corner, as described previously. As is shown in FIG. 13, a deflectable collar **300*a* is positioned above the drill bit 40 in the drill string 41. At least one conventional drill collar 48 is connected in the drill string between the deflectable collar 300*a* and the drill bit 40**. When articulated, the rotational axis of the drill string elements above the deflectable collar is non-colinear relation with the rotational axis of the drill string elements below the deflectable collar.

The drill string can be articulated during a predetermined interval or portion of each drill string revolution by employing the deflectable collar of the present invention and its energizing and control apparatus described previously.

Figure 14:
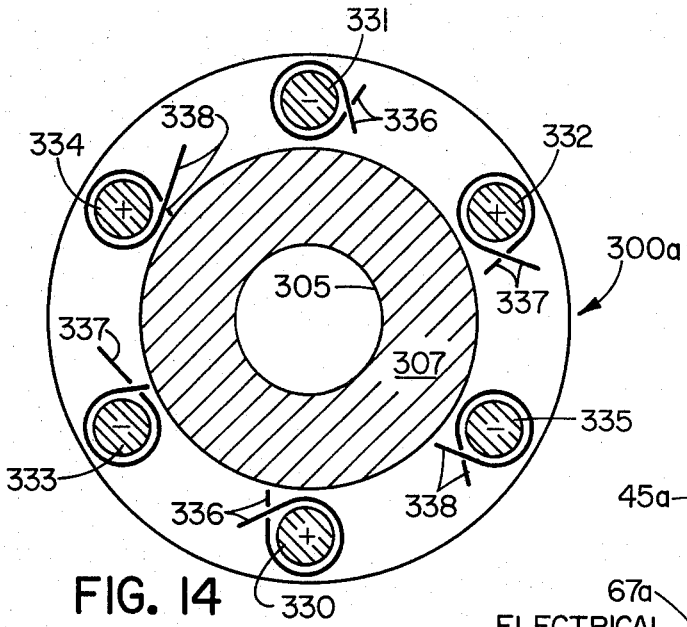
FIG. 14 is a transverse sectional view of the deflectable collar illustrated in FIG. 13 taken substantially in the plane of line 14—14 of FIG. 13.

An arrangement for constantly inducing a stationary bend or articulation in the drill string as it rotates is illustrated in FIGS. 13 through 16. The deflectable collar **300*a* shown in FIGS. 13 and 14 is essentially of the same construction as the deflectable collar 300 illustrated in FIGS. 10 and 11, with the exception that the strictive material deflectable elements are arranged in a different order and in different positions. Three sets of positive and negative magnetostrictive rod-like elements, for example, are employed in the collar 300*a*. A positive magnetostrictive element 330 and a negative magnetostrictive element 331 are positioned on diametrically opposite sides of the deflectable collar 300*a* and form one of the three sets of magnetostrictive elements. A second set of elements is defined by a positive magnetostrictive element 332 and a diametrically oppositely positioned negative magnetostrictive element 333. The last set of elements is defined by a positive magnetostrictive element 334 and diametrically oppositely positioned magnetostrictive element 335**. The positive and negative magnetostrictive elements of each set are thus angularly displaced from one another by 180°. The positive and negative magnetostrictive elements of each set are angularly displaced 120° from the respective positive and negative elements of another set, and each circumferentially adjacent magnetostrictive element is positioned at an interval of 60°.

Each magnetostrictive element is surrounded by a solenoid defined by a plurality of coils of an electrical conductor. Although any suitable electrical connection arrangement can be utilized, preferably a single conductor defines the solenoids for each set of magnetostrictive elements. For example, a conductor 336 is wound around both magnetostrictive elements 330 and 331 and defines the magnetizing solenoids for the set of elements 330 and 331. Another separate conductor 337 is wound around the set of magnetostrictive elements 332 and 333 to define the magnetizing solenoids for that set of elements. A third separate conductor 338 is wound around the magnetostrictive elements 334 and 335 and defines the magnetizing solenoids for those elements. By this electrical arrangement each set of positive and negative magnetostrictive elements can be separately energized.

Each energized set of magnetostrictive elements thereby creates its own deflecting effect on the collar 300*a*.

Figure 15:
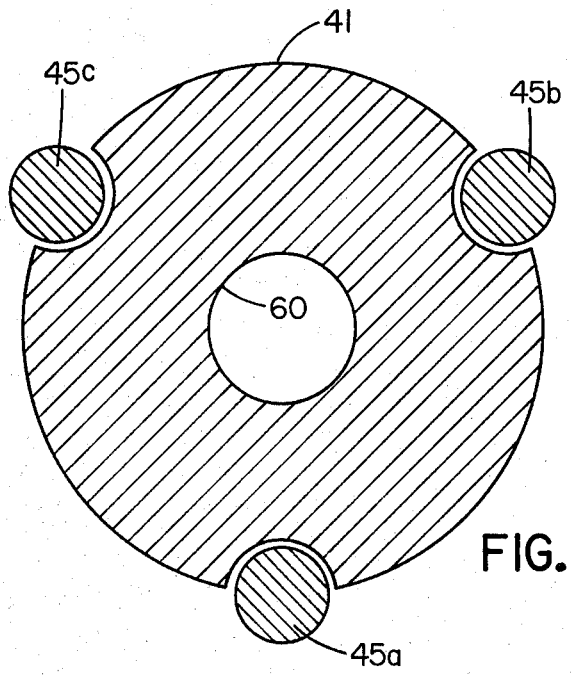
FIG. 15 is a generalized cross sectional view of a portion of the control and energy deriving apparatus of FIG. 13 taken substantially in the plane of line 15—15 of FIG. 13 and oriented in exemplary relative position to the deflectable collar shown in FIG. 14.

An arrangement for separately energizing each set of magnetostrictive deflectable elements in such a manner to induce a substantially constant and stationary bend or angle in the drill string as it rotates is illustrated in FIGS. 13 and 15. Three roller members 45*a*, 45*b* and 45*c* are operatively connected at equal circumferential angles to the drill string 41 at a position 42 at which gravity induced sag in the drill string causes the roller member to contact the low side portion of the sidewall. Each roller member 45*a*, 45*b* and 45*c* operatively drives its own electrical generator 67*a*, 67*b* and 67*c* respectively. The rollers 45*a*, 45*b* and 45*c* are positioned at equal rotational intervals on the drill string, and each roller will thereby contact the low side portion at equal rotational and time intervals and will roll over the low side portion for approximately consistent arcuate or rotational durations of the drill string rotation. During the time that the rollers contact and roll against the low side portion of the sidewall, the electrical generators driven by the rollers to generate and supply electrical current. In essence, each of the roller member and generator combinations is essentially similar to the energy deriving means 43 previously discussed in conjunction with FIG. 9.

Figure 16:
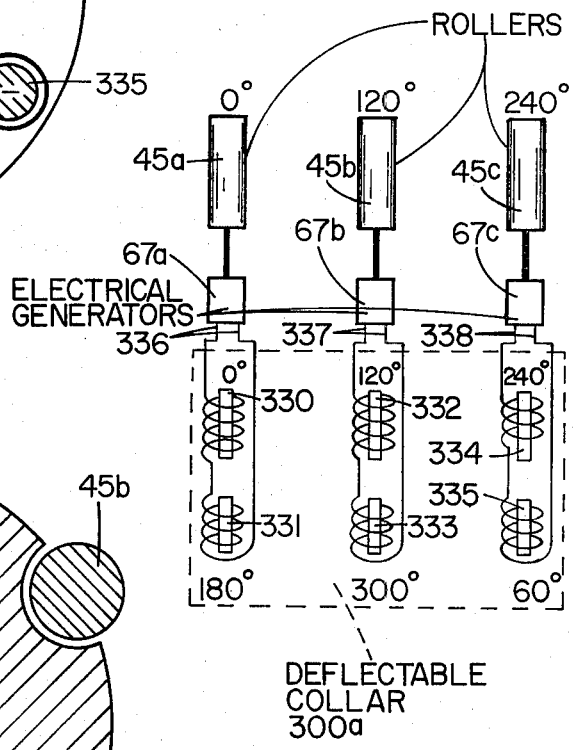
FIG. 16 is a schematic illustration of elements of the control and energy deriving means shown in FIGS. 13 and 15 and deflectable collar shown in FIG. 14 all of which is shown in exemplary relative rotational position.

The current supplied by the generators 67*a*, 67*b* and 67*c* is supplied respectively to conductors 336, 337 and 338 as is shown in FIG. 16. The current from generator 67*a* operatively creates the magnetic field which acts on the set of magnetostrictive elements 330 and 331. Similarly, the current from generators 67*b* and 67*c* operatively creates the magnetic fields which act on the sets of magnetostrictive elements 332, 333 and 334, 335 respectively. Consequently each generator operatively energizes one set of strictive material deflectable elements when the associated driving roller contacts the low side portion of the borehole sidewall.

The operative arrangement of the elements is best described in conjunction with FIG. 16. When roller 45*a* contacts the low side portion of the sidewall, electrical generator 67*a* supplies current over the conductor 336. The magnetizing solenoid defined by the coils of the conductor 336 around the magnetostrictive elements 330 and 331 creates and applies a magnetic field to the magnetostrictive elements. The magnetostrictive elements 330 and 331 bend the deflectable collar 300*a* in a manner so as to articulate the drill string. Similarly, as roller 45*b* contacts the low side portion of the sidewall at or slightly before the roller 45*a* moves out of contact with the low side portion of the sidewall, the electrical generator 67*b* supplies current over conductor 337 to the magnetizing solenoids associated with the magnetostrictive elements 332 and 333. At this rotational position, the magnetostrictive elements 332 and 333 have rotated into approximately the same position at which the magnetostrictive elements 330 and 331 previously were when they became energized. Consequently, the magnetostrictive elements 332 and 333 deflect the collar 300*a* in approximately the same stationary direction even though the drill string has rotated. The magnetostrictive elements 332 and 333 remain energized and the collar 300*a* remains deflected over approximately the same rotational interval and arc that the magnetostrictive elements 330 and 331 were previously energized and the collar deflected. As a result, the deflectable collar bends in the same relative stationary direction as it was bent by energization of the magnetostrictive elements 330 and 331 during the previous interval of drill string rotation. Similarly, the roller 45*c*, generator 67*c* and magnetostrictive elements 334 and 335 also operatively cause the collar 300*a* to bend in the same relative stationary position during the third interval of drill string rotation. The foregoing operation repeats itself during the next and each subsequent drill string revolution so as to maintain the deflectable collar 300*a* in a relatively stationary bent manner to continually articulate the drilling apparatus below the deflectable collar in the constant direction in which it is desired to change the borehole angle.

Although three sets of magnetostrictive elements and three separate roller and generator combinations have been illustrated, it is apparent that any appropriate number could be utilized. Furthermore groups of positive magnetostrictive elements could be substituted for the single positive magnetostrictive elements illustrated in FIG. 14 and groups of negative magnetostrictive elements could be similarly substituted for the single magnetostrictive elements illustrated in FIG. 14. Substitution of groups of magnetostrictive elements for single magnetostrictive elements shown has the effect of increasing the deflection force available at the deflectable collar. Furthermore, the roller members 45*a*, 45*b* and 45*c* can each be arranged to switch current from an external source, by utilizing an arrangement such as that shown in FIG. 12 for each set of magnetostrictive elements of the deflectable collar 300*a*.

From the foregoing description, it is apparent that effective angle changes can be achieved by very small effects created by deflection of the deflectable collar of the present invention. Furthermore, the deflectable collars of the present invention cooperate with known rotary drill bits to achieve a normal and acceptable rate of drilling penetration as the advancement angle of the borehole is changed or controlled. The control and energy deriving apparatus operates reliably and consistently as an inherent result of drill string rotation. Furthermore, the control and energy deriving apparatus operates in predetermined correlated relationship with a stationary reference, the low side portion of the sidewall, and controls the drill bit relative to the stationary reference to achieve consistent angle control effects from one revolution of the drill bit to the next. It is apparent, therefore, that the present invention significantly advances the development of the art relative to controlling the advancement angles of boreholes cut by rotary drill bits.

Preferred embodiments of the present invention have thus been described with a degree of particularity. It should be understood, however, that the specificity of the present disclosure has been made by way of example, and that changes in details of features may be made without departing from the spirit of the invention.

I claim as my invention:

1. A deflectable collar adapted to be connected to a drill string in drilling apparatus, comprising:

at least one strictive material element operatively connected to said deflectable collar to deflect said collar under the influence of energizing force applied to said strictive material element, said strictive material element having the characteristic of changing in length in at least one dimension under the influence of an energizing force applied to said element; and means operatively associated with said strictive material element for applying an energizing force to said strictive material element of sufficient strength to change the length of said strictive material element.

2. A deflectable collar as defined in claim 1 wherein:

said strictive material element is a magnetostrictive element; and said energizing force applying means comprises means for applying a magnetic field of predetermined strength to said magnetostrictive element.

3. A deflectable collar as defined in claims 1 or 2 further comprising two end portions adapted to connect to the drilling apparatus, and a middle portion extending between the two end portions, the middle portion being of reduced cross sectional area as compared to the end portions.

4. A deflectable collar as defined in claim 3 wherein each said strictive material element extends longitudinally of said collar between the end portions and is radially adjacent the middle portion.

5. A deflectable collar as defined in claim 4 further comprising a plurality of strictive material elements, at least one of said plurality of strictive material elements being a positive strictive element which expands in length under the influence of an energizing force and at least one of said plurality of strictive elements being a negative strictive element which contracts in length under the influence of an energizing force, each positive strictive element being positioned diametrically opposite from each negative strictive element and said deflectable collar.

6. A deflectable collar as defined in claims 1 or 2 wherein said strictive material elements deflect said collar an amount which changes the axes of the drilling apparatus connected at opposite ends of said collar from an essentially colinear relationship to an essentially noncolinear relationship.

7. A deflectable collar as defined in claims 1 or 2 further comprising, in combination:

a rotary drill bit adapted for cutting a borehole;

a drill string adapted to be rotated and to extend generally axially into the borehole;

means for rotating said drill string;

means for connecting said deflectable collar as a part of the drill string within the borehole;

means for connecting said drill bit to an end of the drill string and to rotate with the drill string within the borehole; and energizing means connected for activating said energizing force applying means over a selected partial interval of one rotation of said drill string.

8. An invention as defined in claim 7 wherein said energizing means activates said energizing force applying means at approximately the same relative rotational position and over approximately the same angular rotational duration during a number of sequential revolutions of said drill string.

9. An invention as defined in claim 7 wherein said energizing means is operative relative to the rotational position of said drill string for activating said energizing force applying means over corresponding partial intervals of each of a number of sequential revolutions of said drill string.

10. An invention as defined in claim 9 wherein said energizing means activates said energizing force applying means over the same preselected angular arc during a plurality of consecutive revolutions of said drill string, and also initiates and terminates the activation of said energizing force applying means at approximately the same respective rotational positions during the plurality of consecutive revolutions of said drill string.

11. An invention as defined in claim 7 wherein said borehole is defined in part by a sidewall and said energizing means further comprises:

at least one rotatable roller member connected to said drill string at a predetermined position axially spaced from said connected drill bit, the predetermined position being that position at which gravity induced sag in said drill string causes said roller member to contact the low side portion of the sidewall during a partial interval of one rotation of said drill string and to avoid contact with the sidewall during the remaining partial interval of the one rotation;

means operatively connecting said roller member to rotate relative to the drill string and against the sidewall during the partial interval of contact of the roller member with the sidewall;

energy generator means for generating energy upon operation;

connection means for connecting rotational movement of said roller member for operating said energy generating means; and means for transmitting energy from said energy generator means to activate said energizing force applying means.

12. An invention as defined in claim 11 wherein said roller member is connected in an exposed position on the exterior of said drill string to roll along a portion of the sidewall when in contact with the sidewall.

13. An invention as defined in claim 11 wherein said energy generator means comprises an electrical generator.

14. An invention as defined in claim 7 wherein said energizing means further comprises:

a source of electrical energy;

a conductor operatively connecting said electrical source with said energizing force applying means of said deflectable collar; and controllable switch means operatively connected to said conductor for switching electrical energy from said source to said energizing force applying means during the predetermined interval of one revolution and for terminating the conduction of electrical energy to said energizing force applying means during the remaining interval of the one revolution.

15. An invention as defined in claim 14 wherein said borehole is defined in part by a sidewall, and further comprising:

control means fixed to said drill string at a predetermined position axially spaced from said connected drill bit at which gravity induced sag in said drill string causes said control means to contact a portion of said sidewall during an interval of one revolution of said drill string and to avoid contact with the sidewall during the remaining interval of the one revolution, said control means operatively controlling said controllable switch means to conduct electrical energy from said source to said energizing force applying means.

16. An invention as defined in claim 15 wherein said control means comprises a roller member fixed to said drill string at the predetermined position, and said roller member is operatively connected for controlling said controllable switch means.

17. A method of controlling the angle of advancement of a borehole formed in material by drilling apparatus including a drill string and a rotary drill bit connected to the drill string, said drill bit having cutting elements for cutting the materials and defining an axially extending sidewall of the borehole, said method comprising operations of:

connecting a deflectable collar within and as a part of the drill string;

attaching strictive material deflection elements to said deflectable collar to operatively deflect said deflectable collar upon energization of said strictive material deflectable elements, said strictive material deflectable elements having the characteristic of changing in length upon the energization thereof;

positioning said drill bit in contact with the material;

continuously rotating said drill bit and drill string;

energizing said strictive material deflectable elements sufficiently to deflect said deflectable collar during a preselected partial revolution of said drill string and drill bit; and de-energizing said strictive material deflectable elements during the remaining partial revolution of said drill bit and drill string.

18. A method of controlling the angle of advancement of a borehole formed in material by drilling apparatus including a drill string and a rotary drill bit having cutting elements for cutting the material and defining an axially extending cylindrical sidewall of the borehole, a drill face of the borehole extending essentially transversely with respect to the sidewall and a gage corner of the borehole extending circumferentially from the drill face radially outward at an inclination to the cylindrical sidewall, said method comprising operations of:

connecting a deflectable collar directly to said drill bit;

connecting the end of said drill string to said deflectable collar;

attaching strictive material deflectable elements to said deflectable collar to operatively deflect said deflectable collar upon energization of said deflectable elements, said strictive material deflectable elements having the property of changing in length upon the energization thereof;

contacting said drill bit with the material;

continuously rotating said connected drill string and deflectable collar and drill bit; and energizing said strictive material deflectable elements during a partial interval of one complete drill bit revolution sufficiently to deflect said deflectable collar and said directly attached drill bit to position certain cutting elements of said drill bit into an altered effective cutting relationship with the material defining the gage corner circumference of the borehole; and de-energizing said strictive material deflectable elements over the remaining partial interval of said one complete revolution to allow the deflectable collar to return to a non-deflected condition at which the cutting elements of said drill bit maintain the normal effective cutting relationship with respect to the gage corner circumference, said altered cutting relationship of certain cutting elements of said drill bit removing a different amount of material over a preselected partial arc of the circumference of the gage corner as compared to the amount of material removed over the remaining partial arc of the circumference of the gage corner when said cutting elements attain the normal effective cutting relationship, said preselected partial arc of the circumference of the gage corner corresponding in angular duration to the preselected partial interval of drill string rotation.

19. A method as defined in claims 17 and 18 wherein said strictive material deflectable elements are magnetostrictive deflectable elements.

20. A method as defined in claims 17 and 18 further comprising operations of:

predetermining a position on said drill string axially displaced from said drill bit at which gravity induced sag causes the drill string to contact the low side portion of the cylindrical sidewall during each revolution of said drill string;

fixing control means at the predetermined position on said drill string to operatively contact a portion of the cylindrical sidewall during a partial interval of each revolution of said drill string and to avoid contact with the cylindrical sidewall during the remaining other partial interval of the same revolution of said drill string; and energizing said strictive material deflectable elements during one of the partial intervals of the revolution of said drill string determined by contact of said control means with the cylindrical sidewall; and de-energizing of said strictive material deflectable elements during the remaining partial interval of the drill string revolution.

21. A method as defined in claim 20 further comprising:

arranging said control means for deriving energy from movement of said control means relative to the cylindrical sidewall during intervals of contact with the cylindrical sidewall, and utilizing at least a part of the energy derived by said control means for energizing said strictive material deflectable elements attached to said deflectable collar.

22. A method as defined in claim 21 wherein said strictive material deflectable elements are energized at approximately consistent rotational positions and over approximately consistent partial rotational intervals during a consecutive number of drill string revolutions.

23. A method as defined in claims 17 or 18:

wherein a plurality of strictive material deflectable elements are attached to said deflectable collar at predetermined positions to deflect said collar in substantially any direction transverse to the axis of said collar; and further comprising the operation of energizing certain ones of said deflectable elements during rotation of said collar to induce a relatively stationary bend in said deflectable collar.

24. A drilling assembly, comprising in combination:

a drill string adapted to extend longitudinally into a borehole;

a drill bit supported by said drill string for performing drilling at the terminal end of said borehole; and a deflectable collar comprising strictive material elements and connected in said drill string for changing the direction of drilling with said drill bit upon energization of strictive material elements.

* * * * *